US006769838B2

(12) United States Patent
Potts

(10) Patent No.: US 6,769,838 B2
(45) Date of Patent: Aug. 3, 2004

(54) VARIABLE VIBRATORY MECHANISM

(75) Inventor: Dean R. Potts, Maple Grove, MN (US)

(73) Assignee: Caterpillar Paving Products Inc, Minneapolis, MN (US)

( * ) Notice: Subject to any disclaimer, the term of this patent is extended or adjusted under 35 U.S.C. 154(b) by 59 days.

(21) Appl. No.: 10/001,348

(22) Filed: Oct. 31, 2001

(65) Prior Publication Data

US 2003/0082003 A1 May 1, 2003

(51) Int. Cl.[7] ..... E01C 19/38

(52) U.S. Cl. ..... 404/117; 404/130; 74/61; 74/87

(58) Field of Search ..... 74/61, 87; 404/102, 404/103, 113, 117, 122, 130

(56) References Cited

U.S. PATENT DOCUMENTS

| | | | | | |
|---|---|---|---|---|---|
| 2,937,537 | A | | 5/1960 | Woll | |
| 3,590,702 | A | * | 7/1971 | Sechi | 404/117 |
| 3,623,407 | A | | 11/1971 | Dresher | |
| 3,704,631 | A | | 12/1972 | Marks | |
| 3,719,094 | A | * | 3/1973 | Borsutzki et al. | 74/87 |
| 3,814,532 | A | | 6/1974 | Barrett et al. | |
| 3,814,533 | A | | 6/1974 | Buck | |
| 3,909,147 | A | | 9/1975 | Takata | |
| 4,152,943 | A | * | 5/1979 | Wall | 74/87 |
| 4,221,499 | A | | 9/1980 | Breitholz et al. | |
| 4,350,460 | A | | 9/1982 | Schmelzer et al. | |
| 4,454,780 | A | * | 6/1984 | Goehler et al. | 74/87 |
| 4,481,835 | A | | 11/1984 | Storm | |
| 4,561,319 | A | | 12/1985 | Lilja | |
| 4,771,645 | A | | 9/1988 | Persson | |
| 5,005,439 | A | | 4/1991 | Jensen et al. | |
| 5,010,778 | A | | 4/1991 | Riedl | |
| 5,177,386 | A | | 1/1993 | Shimada | |
| 5,253,542 | A | | 10/1993 | Houze | |
| 5,410,879 | A | | 5/1995 | Houze | |
| 5,818,135 | A | | 10/1998 | Riedl et al. | |
| 6,431,790 | B1 | * | 8/2002 | Anderegg et al. | 404/75 |
| 2002/0172556 | A1 | * | 11/2002 | Steffenhagen et al. | 404/117 |
| 2003/0021629 | A1 | * | 1/2003 | Swanson et al. | 404/117 |

FOREIGN PATENT DOCUMENTS

| | | |
|---|---|---|
| EP | 0 926 300 | 6/1999 |

* cited by examiner

*Primary Examiner*—Heather Shackelford
*Assistant Examiner*—Sunil Singh
(74) *Attorney, Agent, or Firm*—Jeff A Greene

(57) ABSTRACT

A vibratory mechanism includes first and second eccentric weights connected to a gearbox. The gearbox includes an inner shaft, an outer shaft and first and second planetary gear sets. The first and second planetary gear sets are connected to a motor that drives the first and second eccentric weights during operation via the inner shaft and outer shaft respectively. A phase control device is operatively connected to the second planetary gear set to index the second eccentric weight relative to the first eccentric weight.

23 Claims, 5 Drawing Sheets

VARIABLE VIBRATORY MECHANISM

TECHNICAL FIELD

This invention relates generally to a vibratory compactor machines and, more particularly, to an infinitely variable amplitude and frequency vibratory mechanism.

BACKGROUND

Vibratory compactor machines are commonly employed for compacting freshly laid asphalt, soil, and other compactable materials. For example these compactor machines may include plate type compactors or rotating drum compactors with one or more drums. The drum type compactor functions to compact the material over which the machine is driven. In order to compact the material the drum assembly includes a vibratory mechanism including inner and outer eccentric weights arranged on a rotatable shaft within the interior cavity of the drum, for inducing vibrations on the drum.

The amplitude and frequency of the vibratory forces determine the degree of compaction of the material, and the speed and efficiency of the compaction process. The amplitude of the vibration forces is changed by altering the position of a pair of weights with respect to each other. The frequency of the vibration forces is managed by controlling the speed of a drive motor in the compactor drum.

The required amplitude of the vibration force may vary depending on the characteristics of the material being compacted. For instance, high amplitude works best on thick lifts or harsh mixes, while low amplitude works best on thin lifts and soft materials. Amplitude variation is important because different materials require different levels of compaction. Moreover, a single compacting process may require different amplitude levels because higher amplitude may be required at the beginning of the process, and the amplitude may be gradually lowered as the process is completed.

Conventional vibratory compactor machines are problematic in that the amplitude and frequency of the vibration force can only be set to certain predetermined levels, or the mechanisms for adjusting the vibration amplitude are complex. One such vibratory mechanism is disclosed in U.S. Pat. No. 4,350,460 issued to Lynn A. Schmelzer et al. on Sep. 21, 1982 and assigned to the Hyster Company.

The present invention is directed to overcome one or more of the problems as set forth above.

SUMMARY OF THE INVENTION

In one aspect of the invention a vibratory mechanism is provided. The vibratory mechanism includes an inner eccentric weight that is rotatably supported within a housing and an outer eccentric weight coaxially rotatably positioned about the inner eccentric weight. An inner shaft is operatively connected to the inner eccentric weight and an outer shaft is coaxially positioned about the inner shaft and operatively connected to the outer eccentric weight. A gearbox is operatively connected to the inner shaft and the outer shaft. The gearbox is adapted to index the outer eccentric weight relative to the inner eccentric weight.

According to another aspect of the invention, a method of operating a vibratory mechanism of a work machine is provided. The vibratory mechanism has a gearbox for adjusting a vibration amplitude. The gearbox includes an inner drive shaft connected with an inner eccentric weight and an outer shaft, surrounding at least a portion of the inner shaft, connected with an outer eccentric weight. The method includes operating the gearbox to change a phase difference between the inner eccentric weight and the outer eccentric weight to change the vibration amplitude.

DETAILED DESCRIPTION

Figure 1:
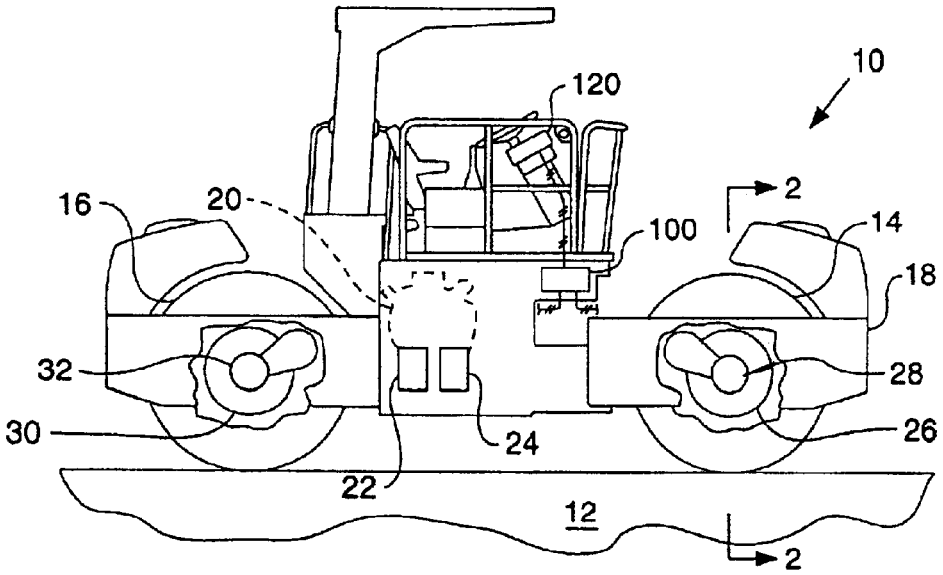
FIG. 1 is a side elevational view of a work machine embodying the present invention.

A work machine 10, for increasing the density of a compactable material 12 or mat such as soil, gravel, or bituminous mixtures, an example of which is shown in FIG. 1. The work machine 10 is for example, a double drum vibratory compactor, having a first compacting drum 14 and a second compacting drum 16 rotatably mounted on a main frame 18. The main frame 18 also supports an engine 20 that has a first and a second power source 22,24 conventionally connected thereto. Variable displacement fluid pumps or electrical generators can be used as interchangeable alternatives for the first and second power sources 22,24 without departing from the present invention.

The first compacting drum 14 includes a first vibratory mechanism 26 that is operatively connected to a first motor 28. The second compacting drum 16 includes a second vibratory mechanism 30 that is operatively connected to a second motor 32. The first and second motors 28,32 are operatively connected, as by fluid conduits and control valves or electrical conductors neither of which are shown, to the first power source 22. It should be understood that the first and second compacting drums 14,16 could have more than one vibratory mechanism per drum.

Figure 2:
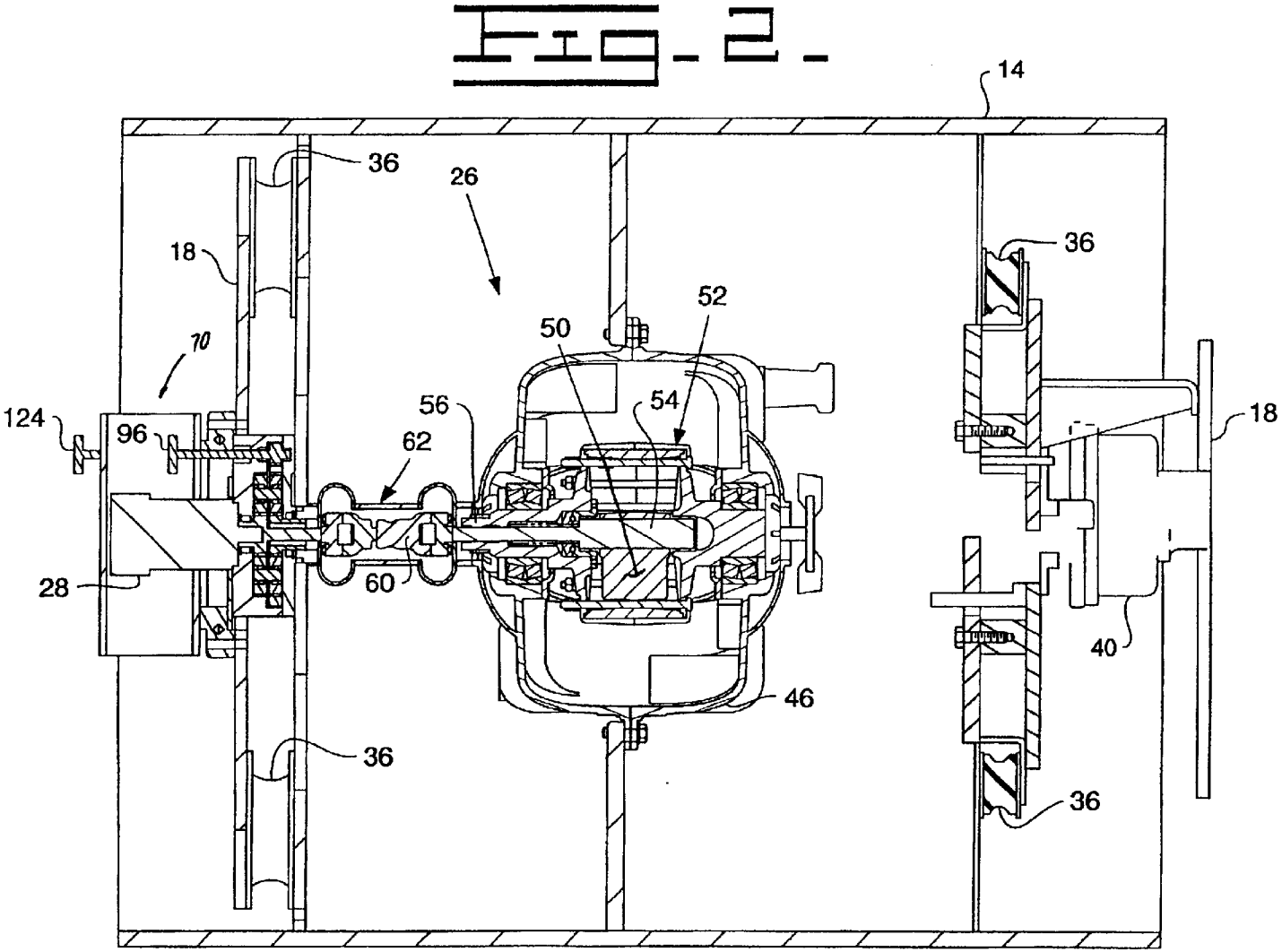
FIG. 2 shows an axial cross section view taken along line 2—2 through a compacting drum of the work machine of FIG. 1 embodying the present invention.

In as much as, the first compacting drum 14 and the second compacting drum 16 are structurally and operatively similar. The description, construction and elements comprising the first compacting drum 14, which will now be discussed in detail and as shown in FIG. 2, applies equally to the second compacting drum 16. Rubber mounts 36 vibrationally isolate the compacting drum 14 from the main frame 18. The first compacting drum 14 includes a propel motor 40 that is connected to the second power source 24. For example, the propel motor 40 is connected to the main frame 18 and operatively connected to the first compacting drum 14 in a known manner. The second power source 24 supplies a pressurized operation fluid or electrical current, to propel motor 40 for propelling the work machine 10.

Referring now to FIG. 2, the vibratory mechanism 26 is contained within a housing 46 that is coaxially supported within the first compacting drum 14 in a known manner. The vibratory mechanism 26 includes a first/inner eccentric weight 50 and a second/outer eccentric weight 52 that are connected to an inner shaft 54 and an outer shaft 56 respectively. Motor 28 drives the inner and outer shafts 54,56 to supply rotational power to the first vibratory mechanism 26 thereby imparting a vibratory force on compacting drum 14. More specifically, the inner shaft 54 is driven by motor 28 via an inner flexible coupling 60, and the outer shaft 56 is driven by motor 28 via an outer flexible coupling 62, as shown in FIG. 2.

Figure 3:
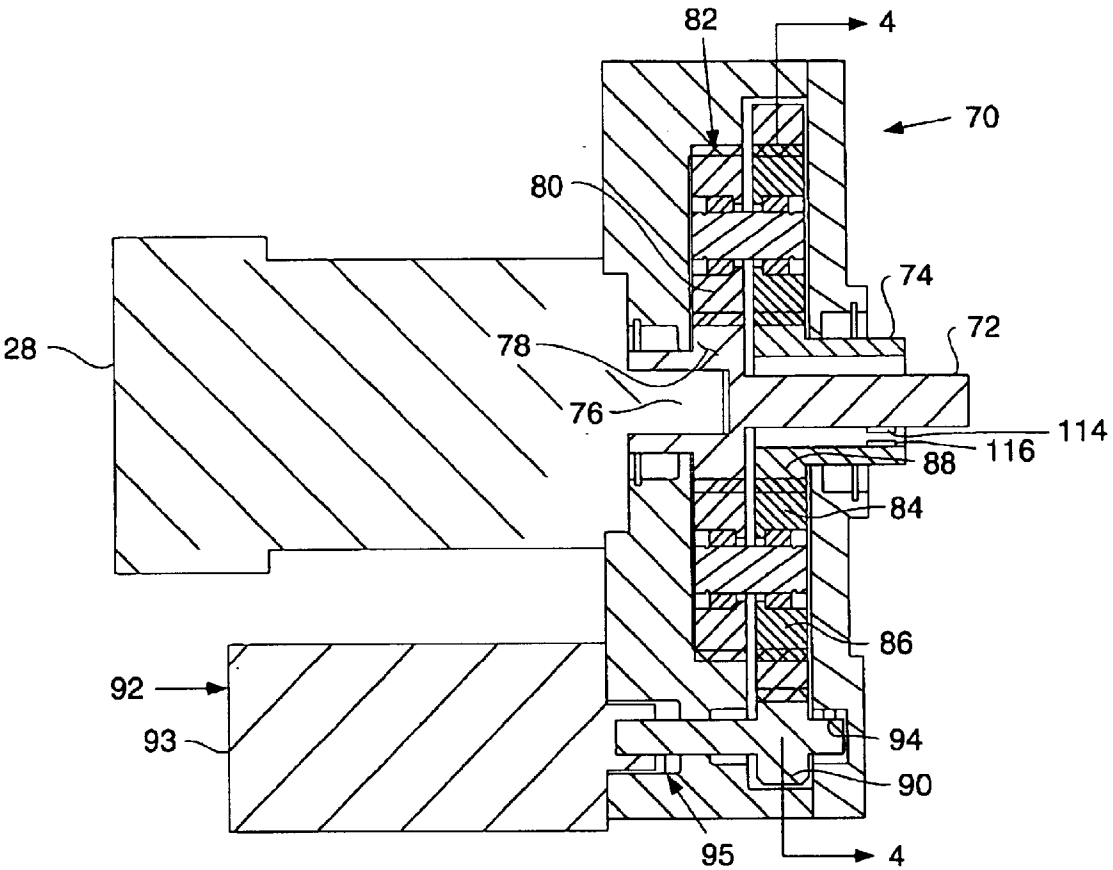
FIG. 3 is an enlarged partial sectional view of the gearbox in FIG. 2.

A gearbox 70 as best seen in FIG. 3 has an inner drive shaft 72 and an outer drive/phase shaft 74. The inner drive shaft 72 is connected to the inner flexible coupling 60, and the outer phase shaft 74 is connected to the outer flexible coupling 62. The gearbox 70 includes two planetary gear sets comprised of sun, planet and ring gears, however other numbers of planetary gear sets would work as well. An output shaft 76 of the motor 28 is connected to the inner drive shaft 72 of the gearbox 70. The inner drive shaft 72 also has an input sun gear 78 fixed to it (or formed integrally therewith) that drives a first planetary gear set 80. This first planetary gear set 80 revolves in a fixed ring gear 82 that is encased in the gearbox and to which the motor 28 is fixedly attached. The first planetary gear set 80 is fixed to an identically sized second planetary gear set 84 that revolves within a moveable ring gear 86. The second planetary gear set 84 drives an output sun gear 88, which may be integral with the outer drive/phase shaft 74 that is mounted on bearings and is concentric to the inner drive shaft 72.

Figure 4:
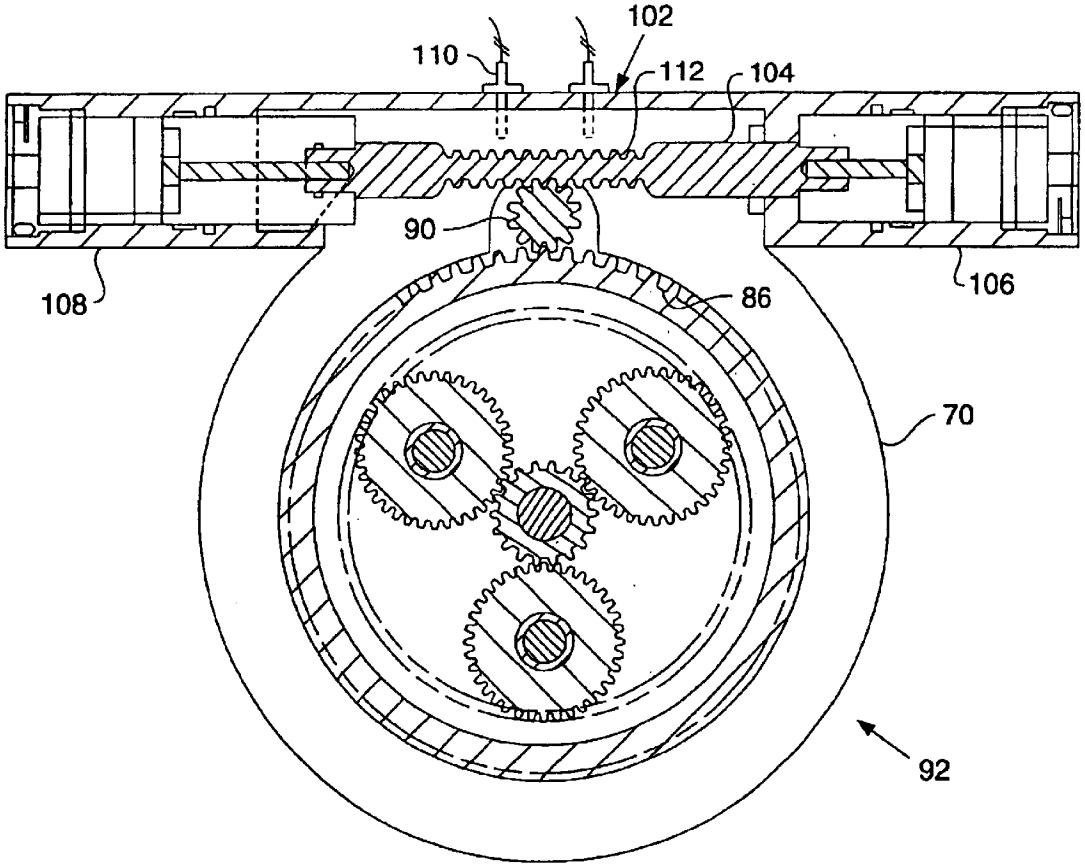
FIG. 4 is a fragmentary perspective view of an alternative embodiment taken along line 4—4 through the gearbox of FIG. 3.

The moveable ring gear 86 is connected through a pinion gear 90 to a phase control device 92 mounted on the gearbox 70 in a conventional manner, as shown in FIG. 3. Phase control device 92 is a motor 93 with a rotary sensor 94 attached to an output shaft 95 to provide an indication of position to a controller 100. As a first alternative to the phase control device 92, a hand wheel 96 connected to the pinion gear 90 will function in a similar manner. As a second alternative to the phase control device 92, an actuator 102 for driving the moveable ring gear 86 in rotation is shown in FIG. 4. Actuator 102 has a rack 104 positioned between two linear actuators 106,108 operation in opposition to each other. Linear actuators 106,108 can be hydraulic cylinders or other electrically controlled devices for supplying linear movement to the rack 104. Dual proximity sensors 110, only one shown in FIG. 4 would sense the teeth 112 over the length of rack travel. For example, the rack might have 18 teeth. With dual proximity sensors 110 sensing the teeth 112 there would be 72 "states" (2.5° resolution) over the length of the rack travel. This is commonly called a quadrature output and can be used to sense both direction and position (via absolute count) in machine control theory. Other types of position sensors could be used for example, linear variable displacement transducers (LVDT), direct resistance linear rheostats, rotary encoders in combination with a device for converting linear movement into rotational movement, and sonar devices.

Speed and phase position sensors 114,116 can be mounted on both the inner drive shaft 72 and the outer drive/phase phase shaft 74. However, a mechanical indicator could also be used to show relative shaft position and thereby weight phase if a simpler version of control is desired. Additionally, a ground speed sensor 118 is operatively connected to the propel motor 40.

Figure 5:
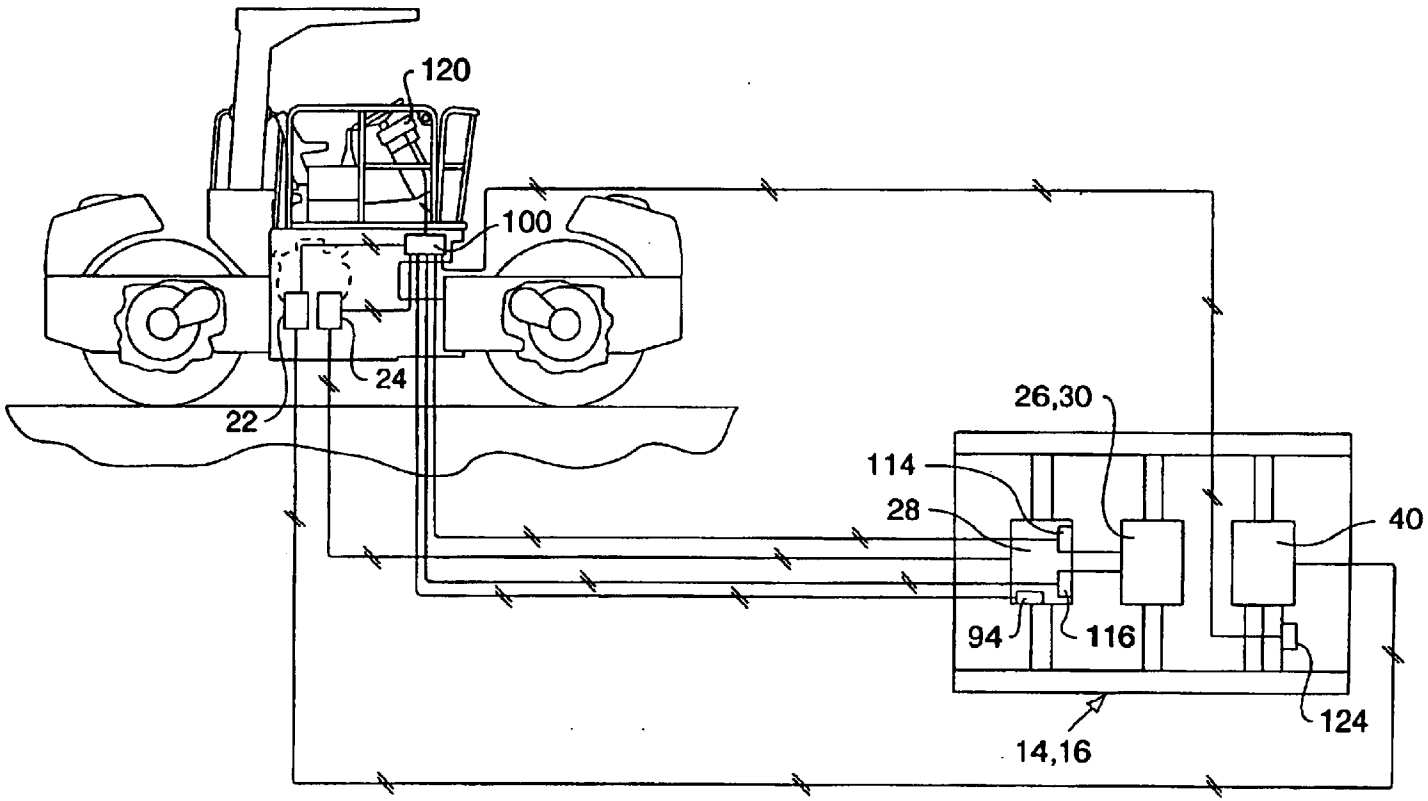
FIG. 5 is a system diagram.

Typically, as shown in FIG. 5, the controller 100 is attached to the speed/phase position sensors 114,116 with input control from an operator interface 120 and output control to the first power source 22 for driving the vibrator propel motor 28. Operator interface 120 is defined as being any known device or combination of input devices such as touch screens, levers, rotary knobs, push buttons, joysticks and the like. The second power source 24 drives the propel motor 40, and is also controlled by the operator interface 120 and/or by controller 100.

The controller 100 also controls the phase motor 92 connected to the moveable ring gear 86 to change phase angle of the inner and outer eccentric weights 50,52. The controller 100 drives the control interface 120 with digital or analog feedback and control as well.

One or more accelerometers 124 can be mounted to the machine frame 18 or drum support to provide added information to the controller 100 to use to make decisions on controlling amplitude and frequency.

The vibratory mechanism 26 can be controlled in three different levels based upon the specific work machine 10 set up with the hardware requirements varying as follows:

Control Level I (maximum capability planned) hardware requirements are the phase shift is driven by a 12 or 24 volt DC motor 92 with an encoder 114,116 to communicate the exact position of the shafts 72,74 relative to each other to the controller 100. Alternatively, a hydraulic motor or cylinder can be used which has a position encoder attached. The controller 100 is a fully programmed microprocessor used to control motor 28 (vibration rpm), phase motor 92 (amplitude) and motor 40 (propel speed) of the work machine 10. The work machine 10 is equipped with one or more accelerometers 124 or other means to sense de-coupling of the drum and these send a signal to the controller 100. Power source 22 is capable of supplying infinitely variable power such as electrical current, or pressurized fluid that is electrically controlled via controller 100. Motors 28,32 are equipped with speed and possibly also phase position sensors 114,116. Work machine 10 includes power source 24 and motor 40 for drum propel. Power source 24 supplies infinitely variable power to propel motor 40 and is controlled by the controller 100. One or more of the motors 40 have a ground speed sensor 118.

Control Level II (Moderate capability with no true microprocessor control) hardware requirements are the phase shift is driven by a 12 or 24 volt DC motor 92 with an encoder 114,116 to communicate the exact position of the shafts 72,74 relative to each other to a control dial on the console. Alternatively, a hydraulic motor or cylinder can be used which has a position encoder attached. Power source 22 is capable of supplying infinitely variable power source such as electrical current, or pressurized fluid control that is electrically driven. The work machine 10 includes the power source 24 and motor 40 for drum propel. Power source 24 supplies infinitely variable power to propel motor 40 and that is electrically driven. One or more of the drum propel motors 40 have a ground speed sensor 118.

Control Level III (minimum electronic control of system) hardware requirements are the phase shift is driven by a manual hand wheel 96 or similar device operatively connected with the gearbox 70. Power source 22 is capable of supplying 3-levels of power source that is electrically (electronically) driven. Positions are forward, reverse and off. The work machine 10 includes the power source 24 and motor 40 for drum propel. Power source 24 supplies infinitely variable power to propel motor 40 and is controlled with either an electrical control or a hydraulic servo control as on conventional machines.

INDUSTRIAL APPLICABILITY

The above-described arrangement the work machine 10 can be configured to operate at different control levels of operation from fully electronic or automatic to manual control with a minimum of electronic control.

With a control level I machine is a fully electronically controlled work machine 10 with a fully programmed microprocessor controller 100. The controller 100 can use a number of preprogrammed control algorithms to vary the amplitude and frequency of the vibrator system to prevent overloading of the bearings, de-coupling and vibrating while the compactor was at a stop.

In operation the operator performs all normal start-up checks required for safe and normal operation of the work machine 10. The operator mounts the work machine 10 and starts the engine 20 in the normal manner and prepares to drive onto the mat 12. The operator selects the number and position of the drums 14,16 that he wants to vibrate via the operator interface 120. He can choose "Front", "Rear" or "Both". Assume he selects the "Both". The work machine responds by operating the motors 28,32 to run in series.

The operator selects "Automatic Vibration" from the operator interface 120. The controller 100 responds by operating the phase motor 92 to shift the inner and outer eccentrics 50,52 so that the amplitude of the vibratory mechanisms 26,30 is zero. The operator selects the maximum impact spacing desired and the controller 100 responds by storing a divisor number into its propel control algorithm. The operator pushes the operator interface to drive forward onto the mat 12. The work machine 10 responds to the operator input moving out of the neutral position by accelerating the vibratory mechanisms 26,30 up to a predetermined RPM. The RPM will be low since the controller 100 assumes that the density will be low and maximum amplitude will be required. (Note: It is assumed that the bearings in the vibrator, the drum mass and the vibrator weight mass are sized so that the machine cannot run in the highest amplitude setting at the highest vibrator speed.)

The work machine 10 responds by gradually increasing the power source to the drum propel motors 40, for example, the gradual increase might be a ramp that is fixed or based on a percentage of maximum travel speed. The operator then commands start the vibrator compacting process from the operator interface 120. The controller 100 responds by quickly (e.g., less than 1 second) driving the vibratory mechanisms 26,30 to a preset amplitude which might be, for example, ⅔ of maximum. The controller 100 checks for an indication of decoupling from the mat 12, finding none then increases the amplitude to maximum. Alternatively, if the controller 100 senses decoupling, it decreases amplitude by, for example, 10% of the total current amplitude.

The operator may then command full forward movement, which would normally produce maximum ground speed available. The controller 100 overrides the command by imposing a speed control limit based on the maximum impact spacing specified prior to beginning compaction. The relevant formula is: RPM/Impact spacing=ground speed. If the operator decides he wants to travel at a slightly slower speed the controller 100 responds by calculating the desired change in travel speed as a percent of available total travel speed and then decreases speed by the same percentage. For example, a desired impact spacing may only allow the machine to travel at 2 mph. If the operator feels that the ground speed is too fast and reduces the travel speed by ½, the controller 100 will then drive the work machine 10 at 1 mph. The operator nears the end of his first pass and commands the work machine to neutral while steering into position for the next pass going in reverse.

The controller 100 responds by driving the displacement to zero quickly and allows the motors 28,32 to coast. The coasting function is to prevent the vibratory mechanisms 26,30 from continuing to run when the work machine 10 is not moving. The controller 100 responds by gradually braking the work machine 10 to a stop.

The operator requests a command from the operator interface 120 to propel the work machine 100 into reverse. The work machine 10 gradually increases speed in the reverse direction to the maximum travel speed possible controlled by impact spacing or by a percentage of the maximum based on operator input. The controller 100 responds by directing power to the vibratory mechanisms 26,30 to drive the RPM up to the same speed as the last pass and increasing amplitude to the same as the last forward pass. The controller 100 checks for decoupling and drives the amplitude control to increase or decrease the amplitude until it determines that it is within, for example, 10% of the maximum amplitude that can be maintained without decoupling. The operator reaches the end of the second pass and repeats the operation for the next forward pass. The controller 100 and work machine 10 behave in the same was as they did at the end of the first pass.

On any pass, if the density of the compactable material 12 causes the machine to decouple at higher amplitudes, the controller 100 drives the amplitude control to a lower setting. At the same time it drives the speed of the vibratory mechanisms 26,30 to increase in proportion so that a constant force is maintained on the weight shaft bearings. It may be desirable to have a separate switch so that the operator can select both amplitude and frequency change simultaneously. Control hardware, such as made by Geodynamik, could be used to vary both.

At the end of the final pass the operator commands to stop vibration. The controller 100 responds by driving the amplitude of the vibratory mechanism to zero. The operator pulls the propel lever to neutral. The controller 100 allows the motors 28,32 to coast to a stop.

Additionally, the control level I configured work machine 10 can also be operated in manual mode. At start up the operator performs all normal start-up checks and mounts the machine, starts the engine 20 and prepares for a compacting operation. The operator selects the number and position of drums 14,16 to vibrate via the operator interface. The controller 100 responds by supplying power from the power sources 22,24 to the appropriate motor(s) 28,32,92,40. The operator selects the "Manual Vibration" position from the operator interface 120. The controller 100 is now bypassed and all signals to the power sources 22,24 are directly controlled by independent Pulse Width Modulated or analog controls (rheostat) on the operator interface 120, which are hardwired to each other.

The operator turns a dial to set the desired amplitude of the drum 14,16. The phase motor 92 is powered until the feedback position of the PWM or Analog device mounted on the phase motor 92 balances the input signal and the phase motor 92 stops. The maximum impact spacing control is inoperative. (Note: a manual type of impact spacing control could be wired in a way similar to that controlling the amplitude.) The operator requests propel and drives the work machine 10 onto the mat 12. The machine 10 responds by accelerating at a rate controlled by the operator. The speed of the work machine 10 is proportional to a desired input from the operator interface 120 between zero and maximum available ground speed for the speed range selected.

The operator inputs a command to accelerate the vibratory mechanisms 26,30. The machine 10 responds by accelerating the motors 28,32 up to a speed that is determined by the maximum setting. At zero amplitude, the vibrator speed may be, for example, 4200 RPM. The vibratory mechanisms 26,30 would stay at this speed until the amplitude requested was increased to a threshold point where the machine 10 dropped to a next lower speed, for example 3500 RPM. At maximum amplitude, the speed might be, for example, 2550 RPM.

If, during compacting, the operator senses decouplage, he manually adjusts the amplitude to a lower amplitude level. The machine 10 responds by driving the phase motor 92 to set the lower amplitude. If the amplitude requested is in the next speed bracket, the power source 22 is set to a higher output which causes higher RPM. The operator drives the machine 10 in the normal fashion and as he nears the end of the first pass and commands the vibratory mechanisms 26,30 stop. The work machine 10 responds by dynamically braking the vibratory propel motors stop. The operator begins the second pass and commands the vibratory mechanisms 26,30 accelerate up to speed as described before.

Control level I can also be operated in an alternate manual mode similar to above. Instead of having a "Manual Vibration" position on the operator interface 120 there is a "Manual ON" position.

The controller 100 is now bypassed and all signals to the power sources 22,24 are directly controlled by independent Pulse Width Modulated or analog controls (rheostat) on the operator interface 120, which are hardwired to each other.

The hard wire controls respond by rotating the motors 28,32 up to, for example 4200 RPM at zero amplitude if the operator has requested propel. If a propel command has not been given the power source 22 will not operate the motors 28,32. The operator then sets the desired amplitude for the vibratory mechanisms 26,30. The work machine 10 is preset and ready for the compacting operation. The maximum impact spacing control is inoperative. Optionally, it could work if hardwired. The operator requests propel and drives onto the mat 12. The work machine 10 responds by increasing ground speed in proportion and responsive to the request by the operator. The motors 28,32 accelerate to speed as soon as the propel lever is moved out of neutral. The speed or frequency of the motors 28,32 is dependent on the amplitude setting. Higher amplitudes have lower speed settings and vice versa.

The operator sends a command from the operator interface 120 to increase the vibration amplitude to the preset level. The machine responds by driving the phase motor 92 to rapidly increase the amplitude to the preset value. At the end of the pass, the operator commands again and the machine responds by driving the amplitude to zero. The operator requests neutral from the operator interface 120. At neutral, the vibratory mechanisms 26,30 begin to coast down to zero RPM. The operator requests a change from neutral position to reverse. The machine responds by driving the vibrator RPM to the preset value. The operator pulls the vibrator switch. The machine responds by driving the amplitude to the preset value. If the operator detects that the drum(s) is (are) decoupling, he will then reduce the amplitude of the vibratory mechanisms 26,30. The machine responds by driving the motor 92 to a lower amplitude setting and decreases or increases the vibrator speed if appropriate.

For bridge decks and other thin lift work the amplitude can be set at a very low level so that the work machine 10 can operate without damaging the structure or the mat 12. If the operator wants to operate in a static mode and selects vibratory mechanisms 26,30 off and all vibrator control is lost and the system is off.

A control level II work machine 10 has moderated capability with no filly true microprocessor control. The operator performs all machine and normal start-up checks required for safe and normal operation and mounts the machine 10 and starts the engine 20 in the normal manner and prepares to drive onto the mat 12.

The operator selects the number and position of the drums that he wants to vibrate via the operator interface 120. He can choose "Front", "Rear" or "Both". Assume he selects the "Both" position. The compactor responds by activation the motors 28,32 to run. Then the operator selects "Automatic Vibration". The work machine 10 is now set to start vibration when a propel command reaches a set point of travel. The operator selects the desired amplitude. The control level II work machine 10 is hardwired to drive the phase motor 92 to the preset desired position. At the same time, a power is set for the power source 22 that corresponds to the amplitude selected. A low amplitude will have a high driver voltage for the power source 22 so that the vibrator will run at maximum speed. A maximum amplitude setting will drive the power source 22 at a low voltage setting to produce 2550 RPM for example.

The operator requests a forward command to drive onto the mat 12. The work machine 10 responds to the control handle moving out of the neutral position by closing a switch that will allow the vibratory mechanisms 26,30 to come on when requested by the operator. The machine 10 also responds by increasing the output of the power source 24 which drives the drum propel motors 40 in proportion to the operator input. The operator pushes or pulls a button on the control handle to start the vibratory mechanisms 26,30 compacting the mat 12. The machine 10 responds by accelerating the vibratory mechanisms 26,30 up to the predetermined speed and also changing the amplitude from zero to the preset at the same time.

The operator nears the end of his first pass and requests neutral from the interface 120 while steering into position for the next pass going in reverse. The machine 10 responds by driving the power source 24 to zero quickly and lowering the output of power source 22. The machine 10 responds by slowing to a stop at a predetermined rate. The operator requests reverse from the interface 120. The machine 10 responds by increasing speed in the reverse and by increasing the output of the power source 22 to drive the RPM up to the same speed as the last pass. The amplitude is also reset to the same level as the last forward pass. The operator reaches the end of the second pass and repeats the operation for the next forward pass. The machine 10 behaves in the same way as it did at the end of the first pass. At the end of the final pass the operator requests stop vibration from the interface 120. The machine 10 responds by driving the amplitude to zero and the power source 22 to zero output. The operator requests neutral from the interface 120. The power source 24 reduces output in response to the request.

Control level II manual mode functions by the operator selecting the "Manual" from the interface 120. The operator selects the desired amplitude, which also pre-selects the maximum vibratory speed.

The operator requests propel and drives onto the mat 12. The machine 10 responds by increasing the output of power source 24 in response to the request. The operator requests vibration. The phase motor 92 drives to the pre-selected amplitude and the power source 22 increases output to the predetermined set point. The operator nears the end of his first pass and pulls the vibrator switch. The machine 10 responds by reducing the amplitude and reducing the output of power source 24. The operation continues as above for subsequent passes.

In control level III automatic mode the operator performs all machine and normal start-up checks required for safe and normal operation. The operator selects the desired amplitude via a manual control at each drum, such as the hand wheel 96 shown in FIG. 2 motor. The operator mounts the machine 10 and starts the engine 20 in the normal manner and prepares to drive onto the mat 12. The operator selects the number and position of the drums 14,16 that he wants to vibrate via a switch located nearby. He can choose "Front, "Rear" or "Both". Assume he selects the "Both" position. The machine 10 responds by activating power source 22 causing the motors 28,32 to run. The operator selects the "Automatic Vibration" from the interface 120. The machine 10 is now set to start vibration when a propel request reaches a set point of travel. Vibration speed is fixed at, for example, 2550 RPM. The operator requests propel forward to drive onto the mat 12.

The machine 10 responds to the request out of neutral by closing a switch that will allow the vibratory mechanisms 26,30 to come on when requested by the operator. The machine 10 also responds by increasing the output from power source 24 which drives the drum propel motors 40 in proportion to the request. The operator pushes or pulls a button on the interface 120 to start the vibrator to compact the mat 12. The machine 10 responds by accelerating the vibratory mechanisms 26,30 up to the predetermined speed. The operator nears the end of his first pass and request neutral while steering into position for the next pass going in reverse. The machine 10 responds by driving power source 22 to zero quickly and reducing output from power source 24. The machine 10 responds by slowing to a stop at a predetermined rate. The operator requests reverse and machine 10 responds by increasing speed in the reverse direction and by increasing output from power source 22 to drive the vibratory mechanisms 26,30 at, for example, 2550 RPM. The operator reaches the end of the second pass and repeats the operation for the next forward pass. The machine 10 behaves in the same way as it did at the end of the first pass. At the end of the final pass, the operator requests stop vibration from the interface 120. The machine 10 responds by driving the power source 22 to zero. The operator request neutral. The power source 24 reduces output in response to the lever position.

Control level III manual mode operates similar to above except the operator selects the "Manual" from interface 120. The operator request propel from the interface to drive onto the mat 12. The machine 10 responds by increasing output from power source 24 in response to the propel request. The operator activates vibration and the power source 24 increases output to its preset maximum. The operator nears the end of his first pass and activates vibration from the interface 120. The machine 10 responds by reducing the output from power source 22 to zero. The operation continues as above for subsequent passes.

The present invention makes it possible to very precisely drive the change in amplitude to a pre-selected position without having to perform a "change and check the result" routine.

Shown and described are several embodiments of the invention, though it will be apparent to those skilled in the art that many changes and modifications may be made without departing from the invention in its broader aspects. Therefore it is intended that the appended claims cover all such changes and modifications as fall within the true spirit and scope of the invention.

What is claimed is:

1. A vibratory mechanism comprising:

a first eccentric weight being rotatably supported within a housing;

a second eccentric weight being coaxially rotatable with said first eccentric weight;

a inner shaft operatively connected to said first eccentric weight;

an outer shaft being coaxially positioned about said inner shaft and operatively connected to said second eccentric weight; and a planetary gearbox having first and second planetary gear arrangements and being operatively connected to said inner shaft and said outer shaft, said planetary gearbox being adapted to index said second eccentric weight relative to said first eccentric weight.

2. The vibratory mechanism in claim 1, including a motor connected to said planetary gearbox to supply rotational input to said first eccentric weight and said second eccentric weight.

3. The vibratory mechanism in claim 1 wherein said first and second planetary arrangements include:

an input sun gear coaxial with said inner shaft and driven by a motor;

an input planetary gear set that meshes with said input sun gear;

a fixed ring gear that meshes with said input planetary gear set;

an output planetary gear set, said input planetary gear set is connected to said output planetary gear set;

a movable ring gear which meshes with said output planetary gear set; and an output sun gear that meshes with said output planetary gear set and drives said outer shaft.

4. The vibratory mechanism in claim 3, further including a pinion gear operatively connected to a phase control device for rotating said movable ring gear to index said second eccentric weight relative to said first eccentric weight.

5. The vibratory mechanism in claim 4, wherein said phase control device is a phase motor.

6. The vibratory mechanism in claim 4, wherein said phase control device is rack and two opposing linear actuators.

7. The vibratory mechanism in claim 4, wherein said phase control device is a hand wheel.

8. The vibratory mechanism recited in claim 1, further including a speed sensor mounted on said inner shaft and another speed sensor mounted on said outer shaft.

9. The vibratory mechanism recited in claim 8, further including:

a motor connected to said gearbox for rotating said inner and said outer shafts;

a sensor connected with a phase control device; and a controller connected to and utilizing an output from said speed sensors and said sensor, to control operation of said motor and said phase control device.

10. A work machine, comprising:

a compacting drum supporting said work machine;

a vibratory mechanism coaxially positioned within said compacting drum;

said vibratory mechanism including;

a first eccentric weight being rotatably supported within a housing;

a second eccentric weight being coaxially rotatable with said first eccentric weight;

an inner shaft operatively connected to said first eccentric weight;

an outer shaft being coaxially positioned about said inner shaft and operatively connected to said second eccentric weight; and a planetary gearbox having first and second planetary gear arrangements and being operatively connected to said inner shaft and said outer shaft, said planetary gearbox being adapted to index said second eccentric weight relative to said first eccentric weight.

11. The work machine in claim 10, including:

a first power source;

a propel motor connected to said compacting drum and operatively connected with said first power source;

a second power source;

a motor connected to the planetary gearbox to rotate said first and said second eccentric weights, said motor being operatively connected to said second power source.

12. The work machine in claim 11, wherein said first and second power sources are hydraulic pumps.

13. The work machine in claim 11, wherein said first and second power sources are electric generators.

14. The work machine in claim 11 wherein said first and second planetary arrangements includes:

an input sun gear coaxial with by said inner shaft and driven by said motor;

an input planetary gear set that meshes with said input sun gear;

a fixed ring gear that meshes with said input planetary gear set;

an output planetary gear set, said input planetary gear set is connected to said output planetary gear set;

a movable ring gear which meshes with said output planetary gear set; and an output sun gear that meshes with said output planetary gear set and drives said outer shaft in rotation.

15. The work machine in claim 14, further including:

a pinion gear; and a phase control device operatively connected to said pinion gear for rotating said movable ring gear to index said second eccentric weight relative to said first eccentric weight.

16. The work machine in claim 15, wherein said phase control device is a phase motor.

17. The work machine in claim 15, wherein said phase control device is rack and two opposing linear actuators.

18. The work machine in claim 15, further including a speed sensor connected with said inner shaft and another speed sensor connected with said outer shaft.

19. The work machine recited in claim 15, wherein said phase control device is a phase motor for rotating said movable ring gear to index said second eccentric weight relative to said first eccentric weight, and an output shaft of said phase motor having a rotary sensor attached therewith.

20. The work machine recited in claim 15, further including:

a speed sensor connected with each of said inner shaft and said outer shaft;

a phase position sensor connected with each of said inner shaft and said outer shaft; and a controller connected to and utilizing an output from a one of said speed sensors and said phase position sensors to control operation of said motor and said phase control device.

21. The work machine recited in claim 20, further including an accelerometer for outputting signals indicative of an amount of vibration created by rotation of said first and second eccentric weights, wherein said controller controls operation of said motor and said phase control device based on the output signals of said accelerometer.

22. A method for operating a vibratory mechanism of a work machine having a planetary gearbox having a first and a second planetary arrangement for adjusting a vibration amplitude, the gearbox includes an inner shaft connected with a first eccentric weight and an outer shaft, surrounding at least portion of the inner shaft, is connected with a second eccentric weight, said method comprising:

operating a one of the first and second planetary arrangements of the planetary gearbox to change a phase difference between the first eccentric weight and the second eccentric weight to change the vibration amplitude.

23. The method recited in claim 22, wherein said operating step is controlled by a computer controller based on at least one of a ground speed of the vibratory compactor, a rotation speed of one or both of the inner shaft and the outer shaft, and an amount of vibration.

* * * * *